United States Patent [19]

Stibbe et al.

[11] Patent Number: 4,833,794

[45] Date of Patent: May 30, 1989

[54] DRYER APPARATUS FOR FLOATING A RUNNING WEB AND HAVING BAFFLE MEANS FOR SPENT RETURN AIR

[75] Inventors: Paul H. Stibbe, DePere; Roy E. Downham; Robert A. Daane, both of Green Bay, all of Wis.

[73] Assignee: Advance Systems, Inc., Oneida, Wis.

[21] Appl. No.: 230,766

[22] Filed: Aug. 10, 1988

[51] Int. Cl.[4] ..... F26B 13/00

[52] U.S. Cl. ..... 34/156; 34/160

[58] Field of Search ..... 34/156, 155, 117, 120, 34/23, 160

[56] References Cited

U.S. PATENT DOCUMENTS

| | | |
|---|---|---|
| 3,680,223 | 8/1972 | Vits . |
| 3,739,491 | 6/1973 | Creapo et al. . |
| 4,182,472 | 1/1980 | Peekna . |
| 4,197,972 | 4/1980 | Daane . |
| 4,197,973 | 4/1980 | Daane . |
| 4,787,547 | 11/1988 | Hella et al. . |

FOREIGN PATENT DOCUMENTS

| | | |
|---|---|---|
| 634244 | 3/1950 | United Kingdom . |
| 1067918 | 5/1967 | United Kingdom . |

*Primary Examiner*—Henry A. Bennet

*Attorney, Agent, or Firm*—James E. Nilles

[57] ABSTRACT

Apparatus for floatingly suspending a running web through an elongated dryer, and having a series of air delivering, individual air bars located along the length of the web for discharging air towards the web for supporting the latter, the spent air then passing into the space between the air bars; and baffle plates having air discharge openings, the baffle plates being located between adjacent air bars for controlling the discharge of spent air from between the bars, in a generally vertical and parallel direction to the longitudinal centerline of the web, to thereby prevent lateral movement of the spent air and consequently prevent lateral movement of the web.

22 Claims, 3 Drawing Sheets

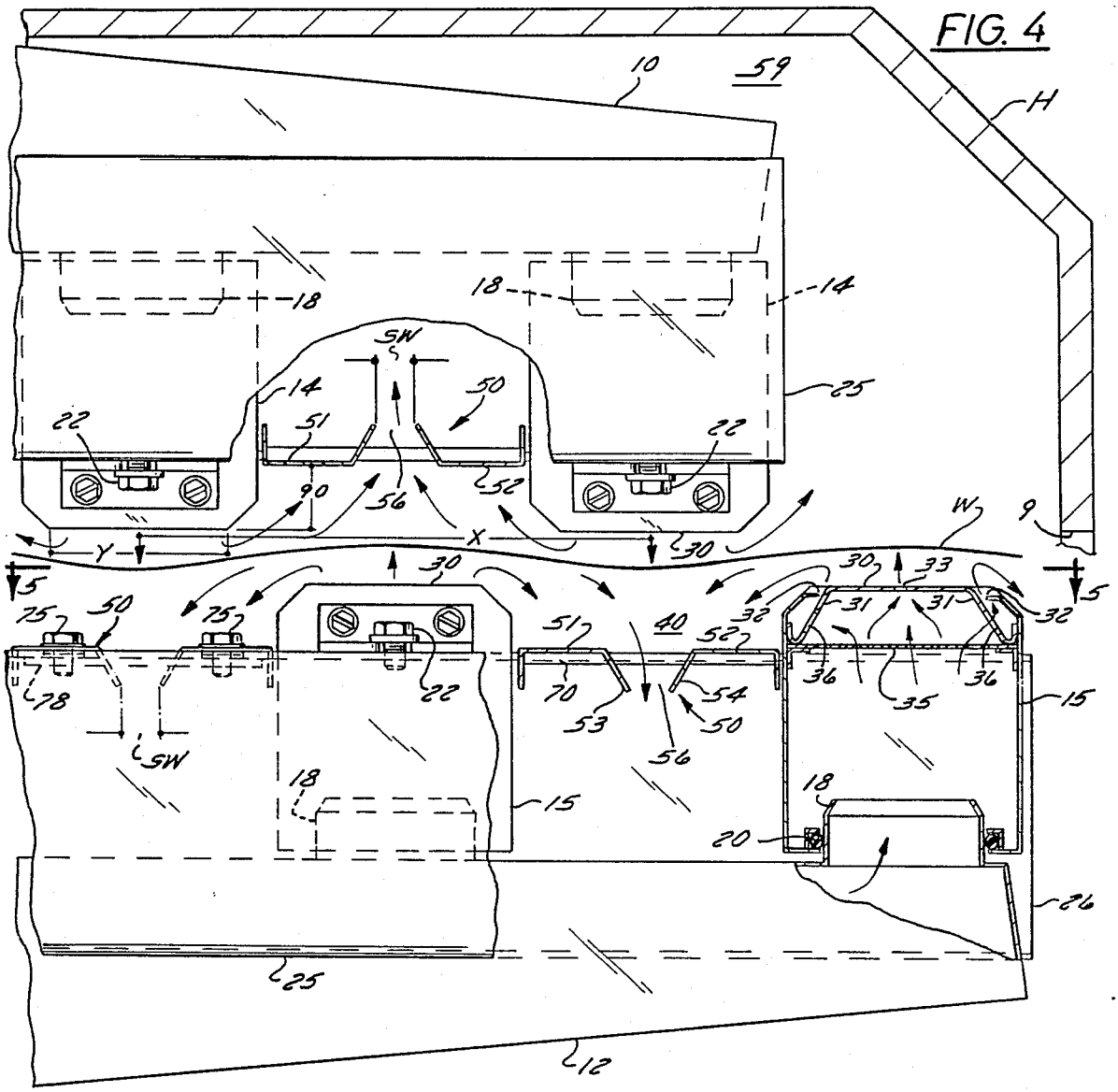
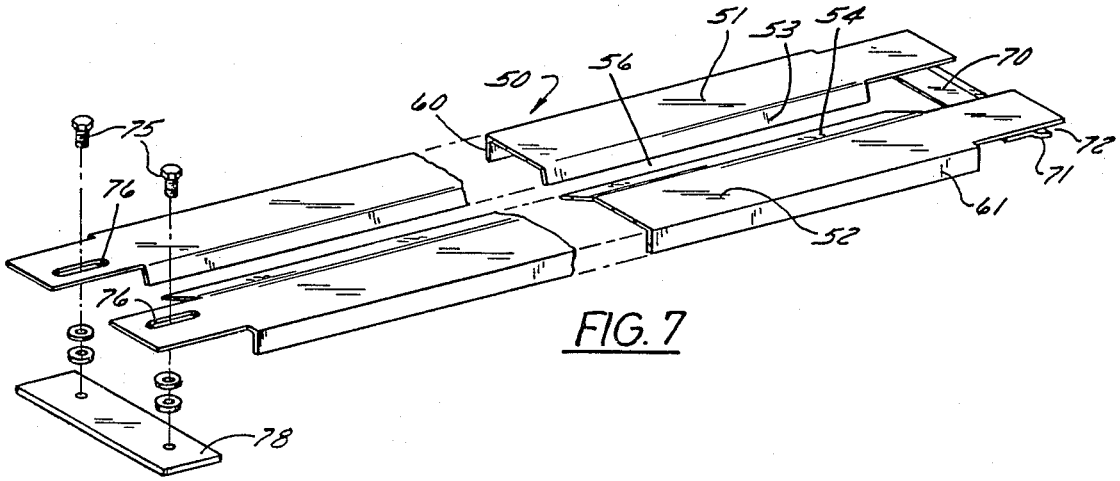
FIG. 7

DRYER APPARATUS FOR FLOATING A RUNNING WEB AND HAVING BAFFLE MEANS FOR SPENT RETURN AIR

FIELD OF THE INVENTION

The invention relates to apparatus for floatingly suspending and guiding a running paper web of indeterminate length through an elongated dryer.

BACKGROUND OF THE INVENTION

The invention pertains to high velocity air web dryers, for example, which force heated air transversely across the moving web to be dried, and air bars having nozzles for directing the heated air are positioned transversely along each of opposite sides of the moving web. Thus the web is suspended without contact while it moves through the dryer. During web offset printing, the web is printed on both sides at the same time, and then enters the flotation-type dryer at about 80° F., exits about 260° to 325° F. and then wraps around a number of large diameter water cooled chill rolls where the thermoplastic ink is "set" by cooling the web to about 90° F. or less. In typical web offset printing applications currently in use, higher press speeds, increased ink laydown, and longer dryers have led to greatly increased lengths of unsupported webs. The unsupported web length is defined as the length of the web between the last printing unit which the web passes through, and the tangent point where the web first makes contact with a chill roll.

When presses are printing two webs at one time, the top web must be printed, then raised above the remaining printing units by using air support turning devices such as shown in the Peekna, U.S. Pat. No. 4,182,472 (FIG. 1), entitled "Contactless Turning Guide for Running Webs". For a typical 40 foot long flotation dryer, the lower web may have an unsupported length of about 50 feet whereas the upper web may have an unsupported length of approximately 75 feet. The longer the length of unsupported web, the more susceptible it is to minor forces that can cause web weave or web shift; that is to say, cause the web to move laterally from one side to the other from its normal longitudinal centerline of travel, or the web may shift to one side or the other and remain there.

Offset press speeds of 2000–2500 feet per minute are common. These high speeds require dryers 30 to 40 feet in length or more, depending upon the basis weight of the paper being printed and dried. Long lengths of unsupported web are adversely affected by laterally moving air currents, unevenly applied ink and water which causes the web to have baggy edges, or uneven or insufficient web tension throughout the press. When any or all of the above circumstances occur, the web will weave back and forth in a side to side motion after it exits from the dyer and attempts to wrap the first chill roll.

Web weave or shift generally occurs during start-up when the press first goes on impression. The web quickly absorbs water and expands in length, decreasing tension between the last printing unit and the chill roll stand. The web sometimes wanders from side to side on the chill rolls, anywhere from +/−1/16" to +/−1" and this is commonly referred to as web "weave". Or it may move suddenly to one side or the other, up to 3" or more and stay there, and this is defined as web shift. Unless the web can be brought back to longitudinal center position, the press must be shut down and the start-up procedure repeated. If the web weave is in the top web, many printers take manual control of a web guiding device in an attempt to keep web weave or shift to a minimum until the press can get up to speed.

Web weave causes waste at the folder end of the press because the printed signatures do not fold over in the same place every time and must be discarded. It is estimated that web weave contributes an additional 1% to 2½% to the direct paper waste factor.

Assuming that each web break caused by web weave results in 30 minutes of press downtime, and that such web breaks average 1½ per shift, we have a total of 375 hours per year in press downtime. At a rate of $1000/hour, the dollars lost per year would amount to $375,000 for press downtime. Add to this a 1½% web waste factor caused by web weave and the total loss to a printer can easily amount to $582,000 per year for a 38" wide two-web press using 50 pound coated stock.

In many cases the web weave or shift is so fast that automatic web steering devices do not react quickly enough to keep the web on track. Such rapid web movement commonly occurs when the press printing units are first put on impression, and ink and water is applied to the web. This moistening of the web causes the paper fibers to expand and can result in a large loss of web tension and/or a "baggy edge".

Web weave and/or shift can occur when going on impression, during the blanket wash cycle, during increases in press speed, during a flood cycle or during a splice. It can and does exist anywhere between the last print unit and the cutoff cylinder located in the folder.

On some occasions, the web will move to one side or the other and stay virtually locked at its new position. The new position may not be "centered" on the press and will prevent the press from producing an acceptable product. To force the web into its centered position, it is sometimes necessary to apply adhesive type tape to the first chill roll to increase its diameter, increase web tension and help force the web to move in the desired direction to a new permanent position.

If the web weave or shift is severe enough, the web may move off the edge of the chill roll and cause the web to break or tear. This in turn forces a press stoppage in order to rethread the paper web through the press. Each web break of this nature will cause a loss of production time of approximately 15–45 minutes. It is often necessary to make two or three attempts to get the press up to speed before the operators are successful in steadying the web movement to the point where the web can successfully be fed all the way through the press.

Any lateral air movements within the dryer will cause the web to move in the direction of air flow and this effect is greater with lower web tension or with a baggy edge. Cross machine air flow patterns are very undesirable.

Some prior art flotation dryers (see FIG. 3) have generally installed air flow devices so as to force the flow of spent air (return air) along a path starting at the centerline of the web being dried and then traveling in a path perpendicular to said centerline to spent air (exhaust air) slots extending the full length of the dryer at the front and back edges of the web. The slots are of a width as determined by calculation and extend parallel to the web edges, front and backside, and sometimes in the center of the dryer.

Other prior art dryers use an open return air concept wherein there is essentially no blockage of the return or spent air after it has impinged on the web, such as shown in British Pat. No. 1,067,918 of May 10, 1967, where the spent air passes transversely and off the web edges. The British Pat. No. 634,244 to Spooner, published Mar. 15, 1950, is not a web floater device, but is a web against a cylinder arrangement. Furthermore, it simply removes the spent air from the same side of the web at which the support jets are located, so that the spent air does not interfere with the support jets of air. These prior art dryers do not control return air flow so as to prevent web weave by avoiding lateral forces (transverse to the direction of web travel) on the web.

Although some prior art was capable of successful production when the dryer and press are completely threaded and up to speed, the problems caused during initial start-up and when making paper roll splices continue to cause frequent web breaks and press downtime. Operating costs remain high on other dryers due to web breaks and downtime caused by web weave or shift.

The prior art does not successfully overcome the problems of web weave or web shift, but many attempt to eliminate web flutter, stretch the web being treated or avoid nozzle interference. See, for example, U.S. Pat. No. 3,680,223 to Vits in which an elaborate return air system is suggested.

With the use of a contactless turning guide for running webs such as in U.S. Pat. Nos. 4,197,972 issued Apr. 15, 1980 to Daane, or 4,182,472, issued Jan. 8, 1980 to Peekna, in web offset presses the problem of web weave became prevalent and web waste increased.

A relationship exists between the length of unsupported web and its width and its susceptibility to web weave or web shift. In the printing industry, where web tensions are relatively high (about 2.0 pounds per lineal inch and above), unsupported web lengths greater than $5 \times W'$ where $W'$ equals the web width in feet, will usually have web weave and web shift problems.

Still other examples of the prior art are shown in U.S. Pat. No. 3,739,491 which issued June 19, 1973 to Creapo et al and is entitled "High Velocity Air Web Dryer". This patent discloses the general arrangement of air bars contemplated by the present invention, the use of headers for supplying the air to said air bars, the insulated oven which contains the air bars and headers, and suitable oven doors, blowers, and exhaust ducts. U.S. Pat. No. 4,197,973, issued Apr. 15, 1980 to Daane, relates to high velocity air bars having air flow straightening means for the discharge slots which attempt to dissipate cross machine momentum components of air movement.

SUMMARY OF THE PRESENT INVENTION

The present invention provides apparatus for floatingly suspending and guiding a running web of indeterminate length through an elongated dryer having return air baffle means for minimizing traverse web movements. More specifically the apparatus includes a housing through which the web passes and a series of individual and elongated air bars are located in the housing, are spaced apart from one another along the length of the web, are located at both the upper and lower sides of the web, the bars on one side of the web being alternately spaced along the web from the bars on the other side of the web to thereby permit the web to form a sine wave. The bars are arranged transversely to the web and the longitudinal direction of web travel, and the bars have a pressure pad surface adjacent said web. Air supply header means are provided in the housing and in air delivering communication with the air bars so the air bars discharge air towards said web for supporting the web, and the spent air then passes into the space between said air bars. Baffle means are located between and generally parallel to adjacent air bars for controlling the discharge of spent air from between said bars, the baffle means having return air discharge openings along their length and through which said spent air passes in a direction generally vertical and parallel with respect to the longitudinal centerline of the web, to thereby prevent lateral movement of the spent air and consequently prevent lateral movement of the web. Another more limited aspect of the invention relates to the discharge openings being continuous slots, and the discharge slot width SW is generally calculated as:

$$SW = \left[ \frac{(X - Y)}{2} + 1.5 \right] \sin 7.5^\circ + 2Z$$

where:

X = air bar center-to-center distance

Y = air bar pressure pad width = distance between air bar slot orifices

Z = nominal orifice width

SW = return air or fluid slot width to extend over entire web width

Still another aspect of the invention relates to the baffle means located a vertical distance from air bar pressure pad surface in a direction away from said web, and where the distance is at least about equal to the width of the baffle means air discharge slots.

These and other aspects of the invention will appear as this disclosure progresses, reference being had to the drawings.

BRIEF DESCRIPTION OF THE DRAWINGS

FIG. 4 is a fragmentary, side elevational view, with parts broken away for the sake of clarity, and other parts shown in section, of an air bar arrangement, the view being taken along line 4—4 in FIG. 5 but on an enlarged scale and also showing the air return baffle means of the present invention;

FIG. 7 is a perspective, exploded view, with parts broken away, of the baffle means shown in FIGS. 4, 5 and 6;

DESCRIPTION OF THE PREFERRED EMBODIMENT

The present invention eliminates the above mentioned web weave or web shift problems. It has been found that a relationship exists between the length of unsupported web and its width and its susceptibility to web weave or web shift. In the printing industry where web tensions are relatively high (about 2.0 pounds per lineal inch and above) unsupported web lengths greater than $5\times W'$ (where W' equals the web width in feet) will usually have web weave and web shift problems. With the present invention, successful commercial installations with an unsupported web length in excess of $24\times W'$ are running successfully at continuous press speeds in excess of 2000 feet per minute.

In prior flotation-type dryers or devices, web weave can occur when the $5\times W'$ requirement is exceeded and/or when the flotation device being used creates such a strong pressure pad that the web comes to equilibrium at a distance greater than about ¼" above the air bar.

As shown, for example, in the co-pending U.S. patent application Ser. No. 61,329, filed June 11, 1987 of Stibbe, now U.S. Pat. No. 4,768,695 of Sept. 6, 1988, some current flotation devices use an air bar system which creates a pressure pad between the web and the air bar. Air bars are positioned alternately above and below a web such that the web passes through the floatation device with a sine wave motion. The undulating sine wave path stiffens the web in the cross machine direction and eliminates edge flutter and web marking. However, the longitudinal stiffness of the web (its resistance to web direction elongation) is decreased by the sine wave. This reduces the web's resistance to web weave and web shift. If the sine wave amplitude is too large, the web is more susceptible to web weave or shift. The sine wave amplitude can be reduced by increasing web tension for any given system. Increasing press tensions is one successful method to eliminate web weave and shift, so long as the increased web tension does not adversely affect printing quality.

Another prior method used to correct some of the above problems is to reduce the air bar outlet velocity which, in turn, reduces the forces causing web weave or web shift. Unfortunately, this method also reduces the drying capacity of the system and can affect the total press productivity.

In the present invention, maximum outlet velocities can be maintained without detrimental web weave problems. Additionally, the apparatus of the present invention can tolerate wide variation in press web tensions without web weave problems.

Figure 1:
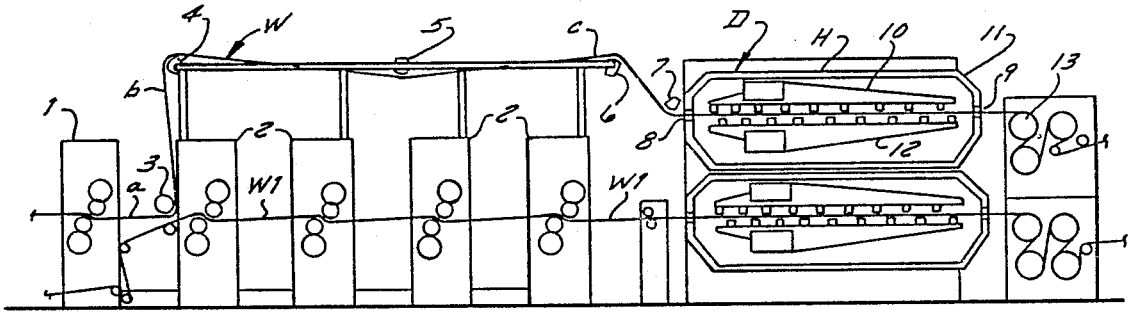
FIG. 1 PRIOR ART
FIG. 1 is a side elevational, schematic view of a double web dryer, as one example only of where the present invention finds utility.

Referring to the drawings, FIG. 1 is a generally schematic, side elevational view of a double web dryer in which an upper web W and a lower web W1 are dried after they leave their respective printing units 1 and 2. Reference will be made only to the upper web W to illustrate its unsupported web length. As web W leaves the last printing unit 1 it travels a horizontal distance a and is then turned (without contact) by the air turn device 3 (of the general type shown in the Peekna U.S. Pat. No. 4,182,472, issued Jan. 8, 1980 or U.S. Pat. No. 4,197,972, issued Apr. 5, 1980 to Daane) and rises in a vertical direction for a distance b where it is again turned 90 degrees by another air turn device 4. The web is then floated, without contact, by other conventional air support devices 5, 6 and 7 and moves horizontally for a distance c. The web then passes through the dryer D, to be described, and exits therefrom to the conventional chill rolls 13.

In the above arrangement, the unsupported length of the web is the sum of the distances a plus b plus c. Even though the upper web "W" turns upward and then horizontal, it is considered as unsupported because it is being conveyed by pneumatic means from the last print cylinder 1 through distances a, b and c to the point of tangency on the first top chill roll 13. Most web weave occurs in the top web because of the longer unsupported web lengths.

The dryer D shown in FIG. 1 may be used one on top of another as shown, or the dryer may be used singly or otherwise. The construction of dryer housing H is conventional and includes the usual insulated walls 11 access door 11*a* (FIG. 3), an inlet horizontal opening 8 for the entry of the web and an exit horizontal opening 9 for the exit of the web from the dryer. Air is forced into the housing from a conventional source such as a blower (not shown), and into the air supply ducts or fingers such as the upper duct 10 and the lower duct 12 which extend longitudinally generally for the length of the interior of the housing. The air from the ducts 10 and 12 is forced into the series of transversely arranged air bars 14 and 15 which are arranged transversely and spaced longitudinally along the length of the dryer and consequently along the length of the web W passing through the dryer. The upper air bars 14 are alternately spaced along the length in respect to the lower air bars 15, thereby causing the web W to form a sine wave curve as indicated in FIG. 2, in the known manner.

The air bars 14 and 15 (FIG. 4) are connected to their respective supply headers 10 and 12 by the telescoping connection which includes the neck portion 18 of the ducts and the o-ring seal 20 carried around the opening of the lower side of the air bars. If a more complete description of the dryer housing, the duct system, or the air bars and their connection to the dryer frame and to the air ducts, reference may be had to the co-pending U.S. application Ser. No. 61,327, filed June 11. 1988 of Hella and Stibbe which will issue as U.S. Pat. No. 4,787,547 on Nov. 29, 1988, and which has been assigned to an assignee common with this application. It is believed sufficient to say that the air bars 14 and 15 are individually removed for repair, replacement or cleaning. This is accomplished by the bolt means 22 at each end of the air bars (FIGS. 4 and 5) and which extend through the longitudinally extending steel members or C-shaped channels 25 and 26 (FIGS. 4, 5 and 6) that are spaced apart transversely from one another and extend in parallelism generally for the length of the dryer. Thus the steel, C-shaped channel members 25 and 26 are provided for each of the upper set of air bars and the lower set of air bars and provide a pair of steel members that extend longitudinally within the housing in transversely spaced apart and in parallel relationship with one another. Thus a series of individual and elongated air bars are located within the housing, are spaced apart from one another along the length of the web, and are located at both the upper and lower sides of the web. The bars on one side of the web are alternately spaced along the web from the bars on the other side of the web to thereby permit the web to form a sine wave.

The air bars each have a pressure pad surface 30 which is located adjacent the web. The air bars also have a pair of slots 32 (FIG. 4), one slot being along each of the upper longitudinal edges of the air bar and adjacent the opposite sides of the pressure pad surface. The bars may also have a series of center holes 33 in surface 30 for the discharge of additional air against the web W, and also have a perforated plate 35 across its interior. Inclined sides 31 have apertures 36 through which air passes to slots 32. These air bars may be of the general type shown in the said U.S. Pat. No. 4,787,547.

Figure 2:
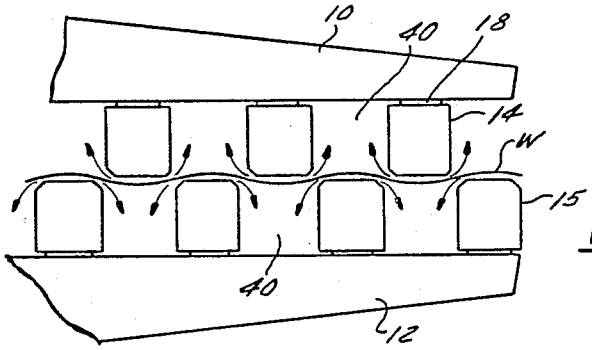
FIG. 2 PRIOR ART
FIG. 2 is a fragmentary, side elevational view, on an enlarged scale of a portion of the air bars and their air supply ducts contained within a dryer, in accordance with the prior art.
Figure 3:
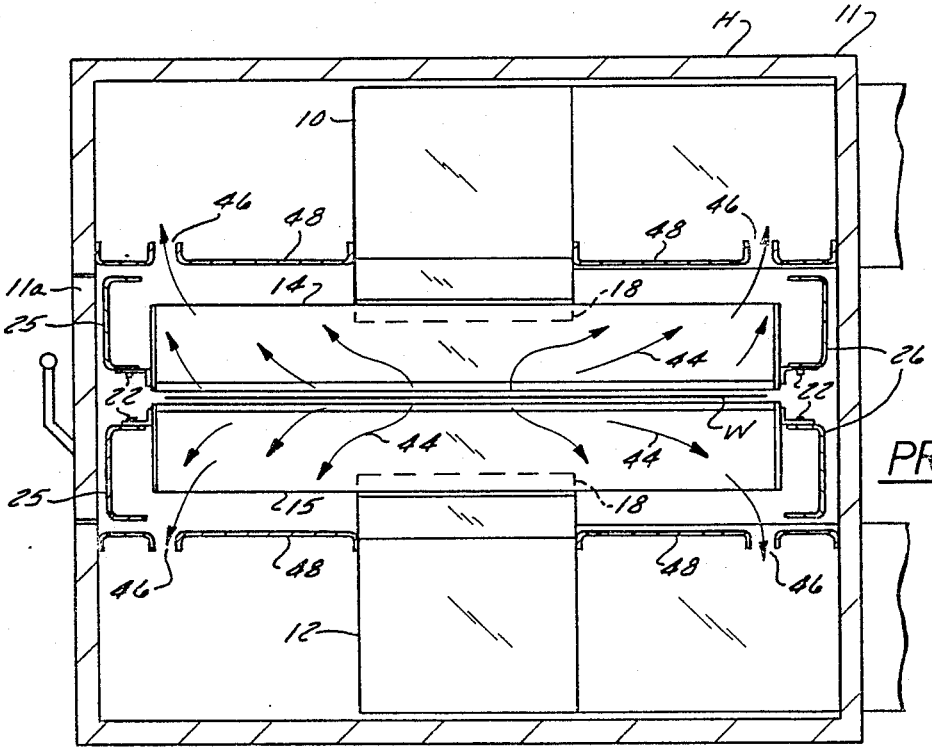
FIG. 3 PRIOR ART
FIG. 3 is a vertical cross-sectional view through a prior art dryer on an enlarged view from the FIG. 2 showing, and illustrating the path of the dicharged air in the prior art.

Prior Art—FIGS. 2 and 3

In operation, the pressurized air enters the air bar through the neck 18 of the duct, into the air bar and then passes through opposite edges of the air bars, in the known manner and then impinges against the web W.

The air then passes into the space 40 between the air bars where in conventional practice it is led away in various different methods and apparatus. In the prior art device shown in FIG. 3 and specifically by the arrows 44, there is a considerable lateral movement of the air, that is transversely across the width of the web and the air is then discharged through the slots 46 in the baffle means 48. This baffle means 48 extends longitudinally in the housing, that is it extends longitudinally in respect to the web and in the direction of longitudinal web movement. It will be noted the baffle means 48 are located at the front edge (operators side) and the back edge of the web. Thus the treating fluid, such as air, is discharged through the conventional slots or orifices of the air bars, impinges on web W and then the air travels obliquely as shown in FIG. 3, if necessary, to the return air discharge slots 46 formed in the baffle means 48 at the front and back edges of the web. Because of the oblique movement of the air as shown in the prior art device of FIG. 3, the web is also caused under many circumstances to shift laterally, i.e. transversely, either to the right or to the left as shown in FIG. 3, that is either to the front or rear side of the housing in a transverse direction. This is referred to as web weave. When the web moves transversely to one side and remains in that position, that is commonly referred to as web shift.

Other prior art devices do not use any baffle means but instead permit the secondary treating fluid to impinge on the web and travel directly and obliquely to the general return area 40.

All of the above mentioned prior art systems, unless absolutely and perfectly balanced, will promote web weave and web shift, as discussed previously.

FIGS. 4 to 8

In accordance with the present invention as shown in FIGS. 4-8 inclusive, there is no lateral movement (see arrows in FIG. 5) of the air as it is discharged from the air bars. This is accomplished by providing elongated baffle means which are located between and fill the space between adjacent air bars for controlling the discharge of the spent air from between the bars. The elongated baffle means have return discharge openings or slots along their length and through which the spent air passes in a vertical direction (see arrows in FIG. 4) and in a parallel direction (see arrows in FIG. 5) relative to the longitudinal centerline of the web. This prevents lateral movement of the spent air and consequently prevents lateral movement of the web.

The openings may be in the form of a series of holes, elongated holes or slots. In practice we have found a continuous slot to be preferable, and reference will be made to slots for illustrating the invention.

One preferred form of the invention is shown in FIGS. 4, 5, 6 and 7, there the elongated baffle means 50 is formed by a pair of sheet metal pieces 51 and 52 which have adjacent, parallel edges 53 and 54 respectively (FIG. 7) which are spaced apart from one another to define a spent air discharge opening or slot 56 for the controlled discharge of the spent air. It will be noted that the inner, adjacent edges 53 and 54 of pieces 51 and 52, respectively are bent away from the web to form a tapered discharge slot 56. The opposite, outer edges 60 and 61 of the pair of sheet metal pieces 51 and 52 are turned away from the web at right angles to provide reenforcing and rigidity for the baffle means.

Figure 6:
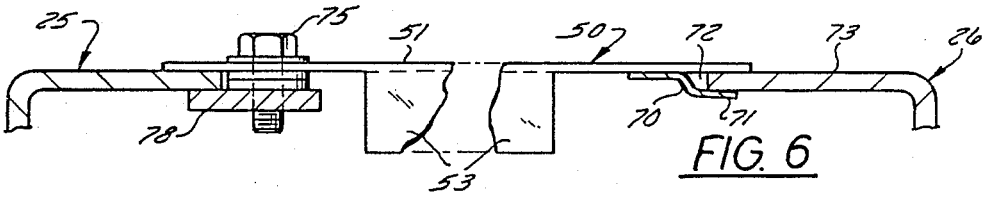
FIG. 6 is a vertical sectional view, with the central portion broken away, and taken along line 6—6 in FIG. 5 but on an enlarged scale, and illustrating the means for removably fastening the baffle means of the present invention on the steel channel members extending through the dryer.

The elongated, preferably sheet metal, baffle means are economically constructed and are easily insertable and removable from the pair of parallel steel members 25 and 26 as follows and as shown in FIGS. 6 and 7. The means for removably securing the baffle means includes a cross member 70 which is spot welded between and to the spaced apart pieces 51 and 52. As shown in FIG. 6, the cross member 70 has a downwardly turned flange 71 which together with the pieces 50 and 52 form a bifurcated opening 72 which is slipped over the inwardly turned flange 73 of the steel member 26. As furthermore shown in FIG. 6, the other ends of the baffle means pieces 51 and 52 are connected by bolt means 75 that extend through elongated slots 76 (FIG. 7) in the ends of the pieces 51 and 52 and bolt means 75 are then threadably engaged in the cross member 78 as shown in FIG. 6, the inwardly turned flange of the steel member 25 is clamped between the baffle means and its cross member 78 when the bolt means 75 is threadably engaged tightly in cross member 78. Thus the baffle means have some adjustment in a transverse direction for ease of installation.

Figure 8:
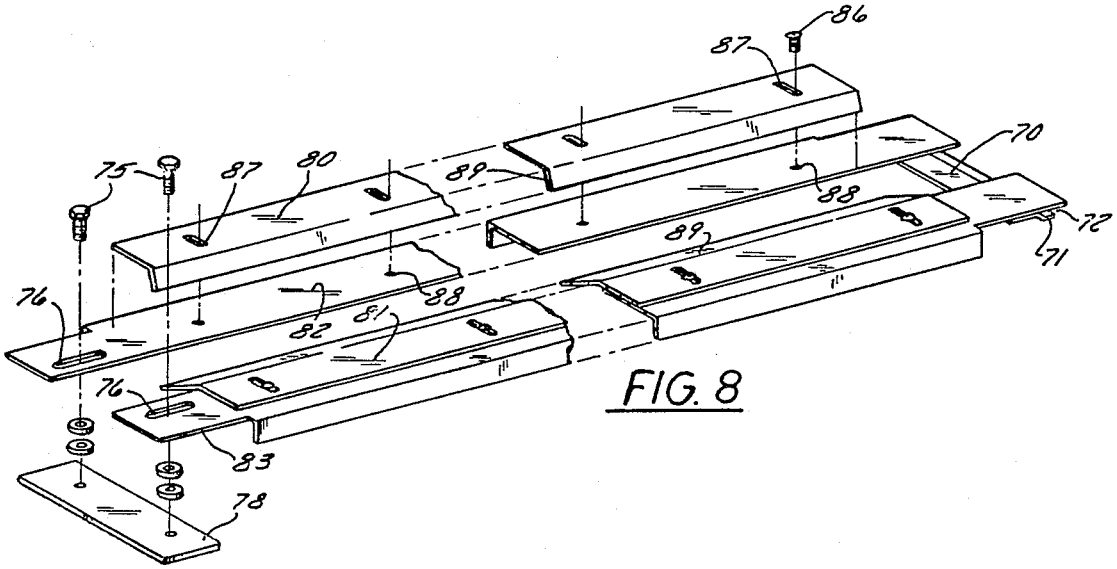
FIG. 8 is a view similar to FIG. 7 but showing a modified form of baffle means having adjustable means for varying the discharge slot size.

Adjustable means (FIG. 8) are provided for varying the discharge width of the slot 56 of the baffle means to thereby better control the web position in a transverse direction. FIG. 8 baffle means is similar to that of FIG. 7 with the exception that an extra, adjustable pair of sheet steel members 80 and 81 are provided for the baffle members 82 and 83, respectively. Members 80 and 81 are adjustably secured to their corresponding member 82 and 83 by the bolt means 86 that extend through the longitudinally slots 87 in members 80 and 81 and are then threadably engaged in the holes 88 of members 82 and 83. Thus the adjustable members 80 and 81 may be shifted in a longitudinal direction, with respect to the web, and thereby vary the width of the spent air discharge slot 56, thereby providing variable spent air exhaust flow. This adjustable means provides for varying the discharge width of the slot 56 and consequently controlling the web position in a transverse direction.

As indicated by the arrows in FIG. 4, the treating fluid, such as air, is discharged from the air bar slots 32 and impinges on the web W. It is important to note that the substantial portion of the air then travels only in vertical planes and in a direction parallel, as indicated by the arrows in FIG. 5 to the longitudinal centerline CW of the web, until the spent air then passes through the discharge slots 56 of the baffle means.

The spent air from the discharge slots 56 enters the general interior 59 of the enclosed dryer housing H, and is generally still at a slight negative pressure, and the air is then exhausted from the housing by means of a conventional fan and exhaust system (not shown). With the present arrangement, the web is maintained in an envelope of air.

With the present invention there is no appreciable lateral air movement of the air. Any stray air flow transversely off the ends of the pressure pad area of the air bars is negligible, because the flow occurs in equal amounts at each edge of the web and the effect is self-neutralizing.

The distance that the baffle means are located from the top or pressure pad of the air bars is not critical as long as this distance is at least equal to the width of the discharge air openings or slots in the baffle means. In other words, the vertical distance 90 (FIG. 4) that the baffle means are mounted from the top pressure pad surface 30 of the air bars is not critical as long as that distance 90 is at least equal to the width SW of the return air slot 56.

In respect to the return air slot 56 size, that size is critical in that if it is too small, too much back pressure of the air is built up and too much drying or treating capacity can be lost. If the discharge slot 56 size is too large, lateral or transverse air movements may be established which are detrimental to weave-less web travel.

Figure 5:
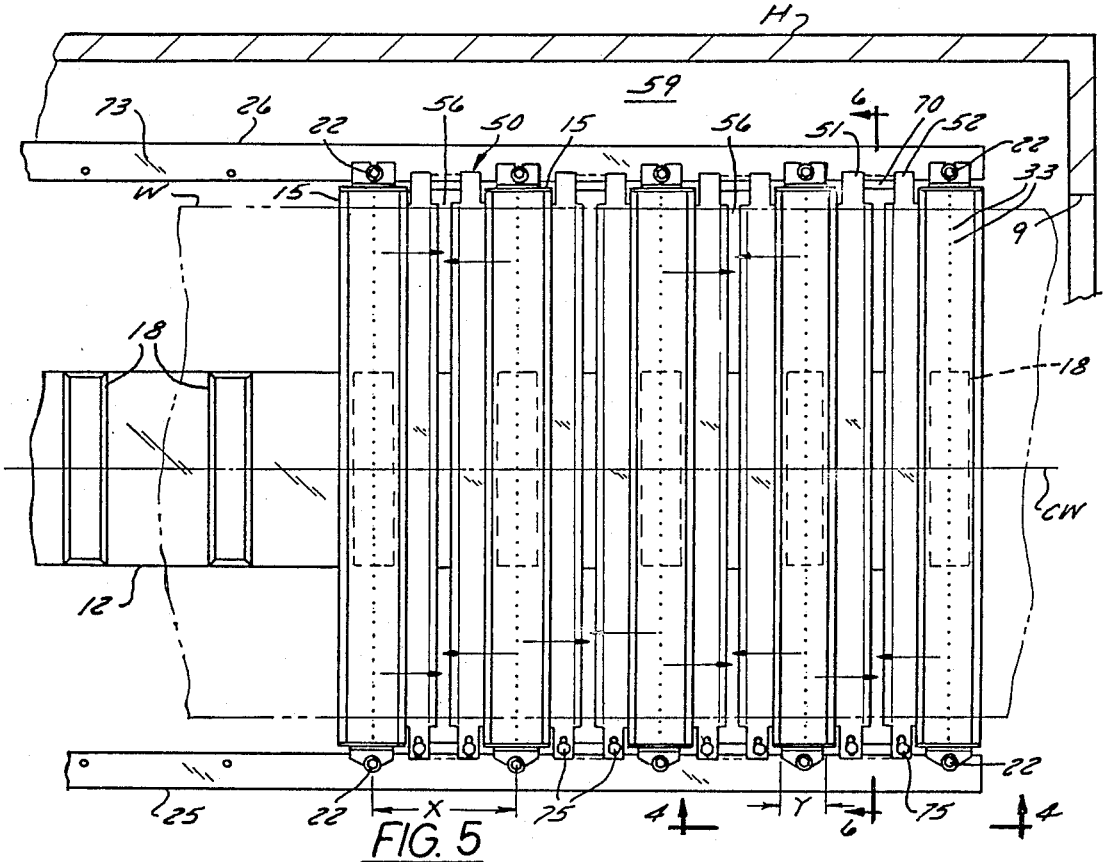
FIG. 5 is a horizontal cross-sectional, plan view, fragmentary in nature and with certain parts being shown as removed or broken away for the sake of clarity in the drawings, and taken through a dryer and illustrating the present invention, the view being taken generally along the line 5—5 in FIG. 4 but on a reduced scale.

Ideally, the return air slot width SW is calculated as:

$$SW = \left[ \frac{(X - Y)}{2} + 1.5 \right] \sin 7.5^\circ + 2Z$$

where:

X=air bar center-to-center distance (FIGS. 4 and 5)

Y=air bar pressure pad width=distance between air bar slots (FIGS. 4 and 5)

Z=nominal air bar slot width (slot 32)

SW=return air slot width to extend over entire web width (FIG. 4).

Recapitulation

The elongated baffle means of the present invention are arranged transversly and are located between adjacent air bars and have discharge slots that extend transversely across the width of the web for controlling the discharge of spent air from between the air bars. As a result, the air discharge from the air bars travel in a direction generally vertically and in a direction parallel to the longitudinal centerline of the web and thus prevent lateral movement of the spent air and consequently prevent lateral movement of the web.

The slots of the baffle means of the present invention can be adjustable to control the web position and force it to one side or the other depending on the direction of web weave.

Both the air bars and the baffle means are removably and individually secured to the same structure of the dryer, namely to the same londitudinally extending steel C-shaped channel members.

With the present invention one of the major causes of web weave or web shift has been eliminated. While the present invention has been illustrated herein as applied to web offset printing press, the invention can also be used for other web handling processes such as coating, laminating, or curing.

We claim:

1. Apparatus for floatingly suspending and guiding a running web of indeterminate length through an elongated dryer, the dryer including, a housing through which the web passes, a series of individual and elongated air bars located in said housing and spaced apart from one another along the length of the web, the bars being located at both the upper and lower sides of the web, the bars on one side of the web being alternately spaced along the web from the bars on the other side of the web to thereby permit the web to form a sine wave, said bars being arranged transversely to the web and the longitudinal direction of web travel, said bars having a pressure pad surface adjacent said web, air supply header means in the housing and in air delivering communication with the air bars, said air bars discharging air towards said web for supporting the latter, and the spent air then passing into the space between said air bars; the improvement comprising, elongated baffle means located and filling the space between adjacent air bars for controlling the discharge of spent air from between said bars, said baffle means having return air discharge openings along their length and through which openings said spent air passes in a generally vertical direction and parallel to the longitudinal centerline of the web, to thereby prevent lateral movement of the spent air and consequently prevent lateral movement of the web.

2. The apparatus set forth in claim 1 further characterized in that said air discharge opening is a continuous slot.

3. The apparatus set forth in claim 1 further defined in that said baffle means is located a vertical distance from said air bar pressure pad surface in a direction away from said web, said distance being at least about equal to the width of the baffle means air discharge slots.

4. The apparatus set forth in claim 2 further characterized in that said discharge slot width SW is generally calculated as:

$$SW = \left[ \frac{(X - Y)}{2} + 1.5 \right] \sin 7.5^\circ + 2Z$$

where:

X=air bar center-to-center distance

Y=air bar pressure pad width=distance between air bar slot orifices

Z=nominal orifice width

SW=return air or fluid slot width to extend over entire web width.

5. The apparatus as described in claim 1 including adjustable means for varying the discharge width of said openings to control web position in a transverse direction.

6. The apparatus described in claim 2 further characterized in that said baffle means are formed by a pair of sheet metal pieces having adjacent parallel edges spaced apart from one another to define a slot as the air discharge slot.

7. The apparatus of claim 6 further characterized in that said adjacent parallel edges are turned away from said web to form a tapered discharge slot to provide variable exhaust flow.

8. The apparatus as described in claim 1 including a pair of steel members extending longitudinally within said housing in transversely spaced apart and parallel relationship with one another, and said air bars and said baffle means having opposite ends which are secured to said steel members.

9. Apparatus for floatingly suspending and guiding a running web of indeterminate length through an elongated dryer, the dryer including, a housing through which the web passes, a series of individual and elongated air bars located in said housing and spaced apart from one another along the length of the web, the bars being located at both the upper and lower sides of the web, the bars on one side of the web being alternately spaced along the web from the bars on the other side of the web to thereby permit the web to form a sine wave, said bars being arranged transversely to the web and the longitudinal direction of web travel, said bars having a pressure pad surface adjacent said web, air supply header means in the housing and in air delivering communication with the air bars, said air bars discharging air towards said web for supporting the latter, and the spent air then passing into the space between said air bars; the improvement comprising, elongated baffle means located and filling the space between adjacent air bars for controlling the discharge of spent air from between said bars, said baffle means having return air discharge slots along their length and arranged parallel to said air bars and through which slots said spent air passes in a generally vertical direction and parallel to the longitudinal centerline of the web, to thereby prevent lateral movement of the spent air and consequently prevent lateral movement of the web; said baffle means being located a vertical distance from said air bar pressure pad surface in a direction away from said web, said distance being at least about equal to the width of the baffle means air discharge slots; said baffle means being formed by a pair of sheet metal pieces having adjacent parallel edges spaced apart from one another to define said discharge slot; said adjacent parallel edges being turned away from said web to form a tapered discharge slot to provide variable exhaust flow.

10. The apparatus as described in claim 9 including adjustable means for varying the discharge width of said slot to control web position in a transverse direction.

11. The apparatus as described in claim 10 including a pair of steel members extending longitudinally within said housing in transversely spaced apart and parallel relationship with one another, and said air bars and said baffle means having opposite ends which are secured to said steel members.

12. The apparatus set forth in claim 9 further characterized in that said discharge slot width SW is generally calculated as:

$$SW = \left[ \frac{(X - Y)}{2} + 1.5 \right] \sin 7.5^\circ + 2Z$$

where:

X=air bar center-to-center distance

Y=air bar pressure pad width=distance between air bar slot orifices

Z=nominal orifice width

SW=return air or fluid slot width to extend over entire web width.

13. A web dryer for floatingly suspending and guiding a running web therethrough, a series of individual and elongated air bars located in said dryer and spaced apart from one another along the length of the web and located at both the upper and lower sides of the web, said bars being arranged transversely to the web and the longitudinal direction of web travel, air supply means in air delivering communication with the air bars, said air bars discharging air towards said web for supporting the latter and causing the spent air to pass into the space between said air bars; the improvement comprising, elongated baffle means located between and filling the space between adjacent air bars for controlling the discharge of spent air from between said bars, said baffle means comprising elongated members extending transversely to a web passing thereover, said members defining return air discharge openings extending along the length of said elongated members and parallel to said elongated air bars, and through which openings said spent air passes in a direction generally vertical and parallel to the longitudinal centerline of the web, to thereby prevent lateral movement of the spent air and consequently prevent lateral movement of the web, said elongated baffle members being individually and replaceably mounted in said dryer and between said bars.

14. The dryer as described in claim 13 including a pair of steel members extending longitudinally within said housing in transversely spaced apart and parallel relationship with one another, and said air bars and said baffle means having opposite ends which are secured to said steel members.

15. The apparatus set forth in claim 13 further characterized in that said air discharge opening is a continuous slot.

16. The apparatus set forth in claim 15 further defined in that said baffle means is located a vertical distance from said air bar pressure pad surface in a direction away from said web, said distance being at least about equal to the width of the baffle means air discharge slots.

17. The apparatus as described in claim 13 including adjustable means for varying the discharge width of said openings to control web position in a transverse direction.

18. The apparatus described in claim 15 further characterized in that said baffle means are formed by a pair of sheet metal pieces having adjacent parallel edges spaced apart from one another to define said air discharge slot.

19. The apparatus of claim 18 further characterized in that said adjacent parallel edges are turned away from said web to form a tapered discharge slot to provide variable exhaust flow.

20. A web dryer for floatingly suspending and guiding a running web therethrough, a series of individual and elongated air bars located in said dryer and spaced apart from one another along the length of the web and located at both the upper and lower sides of the web, said bars being arranged transversely to the web and the longitudinal direction of web travel, said bars having a pressure pad surface adjacent said web, air supply means in air delivering communication with the air bars, said air bars discharging air towards said web for supporting the latter and causing the spent air to pass into the space between said air bars; the improvement comprising, elongated baffle means located between and filling the space between adjacent air bars for controlling the discharge of spent air from between said bars, said baffle means comprising elongated members extending transversely to a web passing thereover, said members defining return air discharge openings extending along the length of said elongated members and parallel to said elongated air bars, and through which openings said spent air passes in a direction generally vertical and parallel to the longitudinal centerline of the web, to thereby prevent lateral movement of the spent air and consequently prevent lateral movement of the web, said elongated baffle members being individually and replaceably mounted in said dryer and between said bars, said baffle means being located a vertical distance from said air bar pressure pad surface in a direction away from said web, said distance being at least about equal to the width of the baffle means air discharge slots, said baffle means being formed by a pair of sheet metal pieces having adjacent parallel edges spaced apart from one another to define said air discharge slot, and adjustable means for varying the discharge width of said slot to control web position in a transverse direction.

21. The apparatus of claim 20 further characterized in that said adjacent parallel edges are turned away from said web to form a tapered discharge slot to provide variable exhaust flow.

22. The dryer as described in claim 20 including a pair of steel members extending longitudinally within said housing in transversely spaced apart and parallel relationship with one another, and said air bars and said baffle means having opposite ends which are secured to said steel members.

* * * * *